United States Patent [19]

Wissman et al.

[11] Patent Number: 4,723,882

[45] Date of Patent: Feb. 9, 1988

[54] APPARATUS FOR FORMING EASY-OPEN CAN ENDS

[75] Inventors: Terry L. Wissman, New Bremen; Robert L. Schockman, St. Henry, both of Ohio

[73] Assignee: The Minster Machine Company, Minster, Ohio

[21] Appl. No.: 936,466

[22] Filed: Nov. 25, 1986

[51] Int. Cl.[4] ..... B21D 51/44

[52] U.S. Cl. ..... 413/66; 72/361; 72/422; 72/405; 413/14; 413/62

[58] Field of Search ..... 413/12, 14, 66, 62, 413/56; 72/361, 405, 346, 422; 198/803.8, 803.15

[56] References Cited

U.S. PATENT DOCUMENTS

| | | | |
|---|---|---|---|
| 3,196,817 | 7/1965 | Fraze | 413/66 |
| 3,245,370 | 4/1966 | Bofinger . | |
| 3,366,086 | 1/1968 | Fraze . | |
| 3,470,837 | 10/1969 | Fraze et al. . | |
| 3,550,546 | 12/1970 | Eickenhorst . | |
| 3,683,665 | 8/1972 | Bradlee | 72/405 |
| 3,683,834 | 8/1972 | Potts et al. . | |
| 3,858,432 | 1/1975 | Voorhees et al. | 72/455 |
| 4,026,226 | 5/1977 | Hahn et al. | 72/455 |
| 4,213,324 | 7/1980 | Kelley et al. | 72/405 |
| 4,475,278 | 10/1984 | Schockman et al. | 29/434 |
| 4,546,873 | 10/1985 | Debenham et al. | 198/836 |
| 4,568,230 | 2/1986 | Brown | 413/14 |

FOREIGN PATENT DOCUMENTS

| | | | |
|---|---|---|---|
| 0124832 | 11/1901 | Fed. Rep. of Germany | 72/346 |

*Primary Examiner*—Frederick R. Schmidt
*Assistant Examiner*—Robert Showalter
*Attorney, Agent, or Firm*—Jeffers, Hoffman & Niewyk

[57] ABSTRACT

A conversion press assembly for forming easy open beverage cans and a transfer belt conveyor therefor. The press assembly comprises a main press having tooling therein for forming the can ends and a can end transfer belt extends therethrough to carry can end blanks from a downstacker or other supply apparatus. Attached to the main press frame is an auxiliary, tab press having its own crankshaft but being driven off the same drive assembly as the main press. Strip stock is fed into the tab press wherein the tabs are formed, and the tabs, still in strip form, are then fed transversely into the main press for attachment to the can ends at a staking station. The transfer belt comprises a plurality of carriers mounted on a flexible belt wherein the carriers include flexible fingers for resiliently gripping the can ends.

16 Claims, 13 Drawing Figures

APPARATUS FOR FORMING EASY-OPEN CAN ENDS

BACKGROUND OF THE INVENTION

1. Field of the Invention

The present invention relates to an apparatus for forming easy-open can ends and the tabs therefor. More specifically disclosed is a press assembly with a multiple lane conveyor operable in a main-frame press, and an appended but independent tab-forming apparatus, which conveyor, press and tab apparatus are operable by a single drive system.

2. Prior Art

Easy-open can end presses cooperating with tab-forming means are known in the art. U.S. Pat. No. 3,245,370—Bofinger discloses a device having a pair of counter-rotating turrets which slightly overlap at one portion of their peripheries. Each turret is provided with a plurality of spaced apertures that are coaxial or aligned with the apertures of the other turret in the region of overlap.

U.S. Pat. No. 3,683,665 relates to a press wherein main tooling is mounted to the main slide and auxiliary tooling, such as that which could be utilized for forming tabs, is driven by auxiliary slides driven off the same crankshaft as the main slide.

U.S. Pat. No. 3,366,086—Fraze teaches a method of forming container tops having tear strip tabs for removal and opening of the container tops. The basic steps of the method are illustrated in FIG. 1 and include a final stage of forming the finished top onto a container, generally a can.

A machine having a main dial plate rotating intermittently and carrying several can ends through work stations is disclosed in U.S. Pat. No. 3,470,837—Fraze et al. A feed mechanism has a stack of can ends, supported in a storage means for feeding through a feed spiral to the main dial plate for processing. The main dial plate is provided with relatively large apertures for nests to receive and support can ends of a particular size and shape. The tabs are preformed on a separate machine and are columnarly arranged above a rearward section of the slide.

U.S. Pat. No. 3,550,546—Eikenhorst illustrates a machine utilizing a main dial plate intermittently rotated to carry can ends through a series of work stations for conversion into easy-open can ends. Tabs for the easy-opening can ends are made in a tab die operable by the ram of the press of the machine, which tabs are fed on a strip to a staking station and affixed to the formed can ends. Tab and can end formation are performed as an integral operaton within the press by operation of the single ram. The tab die is generally located on the bolster bed in proximity to the dial plate and tab feeding mechanism.

U.S. Pat. No. 3,683,834—Potts et al discloses a press apparatus for applying ring tabs to a can end and for performing a plurality of sequential operations on a container end closure. The work stations are arcuately arranged on a rotating turntable 11 and various operations are performed on the can end closures as they pass through the work stations. Similarly, tabs are provided by a plurality of sequential operations in a progressive tab die section 13. Tabs and formed end closures are joined in the combination die assembly which includes progressive die section 13.

U.S. Pat. No. 4,026,226—Hahn et al shows a press apparatus and method for inverted conversion of easy-open metal container ends, which combines the functions of end and tab forming. The tab forming and end forming stations are disposed one above the other and are alternately operable by a vertically reciprocal slide assembly. Continuous stock strip is provided to a vertically arranged tab die set, which loops through and above the formed can ends. The can ends are provided in a dual lane transfer bed arrangement and the formed tabs are staked to the can ends.

A press for converting can ends and the like for an easy opening can structure is disclosed in U.S. Pat. No. 4,568,230—Brown. Upper and lower conversion tooling are located along a converting path at the top and bottom of a conveyor. The conveyor defines a dual lane plurality of stations on opposite sides of the center of the tooling for forming the shells moved by the conveyor. Tab forming tooling, auxiliary to the main tooling, is located on opposite sides of the conveyor and extends transversely of the main tooling. A tab forming path bridges the end of the converting path. Tabs are formed from a strip of metal fed through the tab tooling and guided in a loop to a staking and attachment station of the can end converting path for removal from the strip and attachment to the formed can ends. The can end tooling and tab forming tooling are cooperatively aligned between the guide rods and are operable by the same vertical reciprocal motion of the upper plate of the press.

U.S. Pat. No. 4,213,324—Kelly et al discloses a carrier means for a punch press to secure sheet metal work pieces through successive work stations while maintaining precision alignment between these work stations and relieving clamping pressure between the periphery of the sheet metal and the carrier means. The feed mechanism can be either a belt or a turret type assembly.

U.S. Pat. No. 4,456,873—Debenham et al illustrates an article retention system for transfer equipment particularly for carrying can ends through a series of progressive die work stations. A belt having openings therein for nesting a can end blank runs between fixed rail overlays on the can end edges to secure them in the belt during indexing. Spring actuated means are provided to maintain the belt in contact with the over-the-edge rails.

U.S. Pat. No. 4,475,278—Schockman et al discloses a specific mechanical press structure utilized in part in the press assembly of this application. Said patent is hereby incorporated by reference.

The prior art, generally, teaches a single press utilizing tooling arranged between a bolster and slide, which may have progressive tooling or die arrangements located thereon. Alternatively, the tabs of the easy-open can ends may be provided as finished pieces for joining with the formed can end blanks. Location and retention of the can ends within a conveying belt or turret has represented a problematic area.

In prior art presses where the tab tooling and main can end tooling are reciprocated by the same slide, the slide and its associated tooling area must be sufficiently large to accommodate the number of required tooling stations for both the tabs and can ends. Particularly in a multiple lane conversion press, this typically results in a press which has a high tonnage requirement. If the tab slide is separate from the main slide, it may be possible to make more efficient utilization of space. However, the tab slide is driven by a connecting arm connected to the same crankshaft as the main slide, there results a situation where the much smaller tab slide is being driven by a much larger drive system than is necessary because the crankshaft must also reciprocate the main slide. It is desirable to provide a conversion press assembly wherein the tab tooling and the main can end tooling can be conveniently arranged and the respective sets of tooling can be reciprocated by the efficient application of press tonnage.

SUMMARY OF THE INVENTION

The present invention in one form thereof, particularly relates to a press assembly for producing easy-open can ends and having a first press for forming the easy-open can end workpieces and a second press for forming the tabs for the easy-open can ends which second press is laterally displaced from the first press working zone. A multiple lane conveyor transfers the can ends into the working zone of the first press which working zone accommodates tooling generally mounted on the slide and die bed or bolster. The tooling may be progressive tooling for the forming operations on the can ends. The tabs formed on the second press are transferred to a staking station for joining with the formed can ends and the scrap strip stock is shredded in a scrap shredder associated with the press. The first press, second press, and the conveyor transfer system are coupled to a single drive system. Further, a resilient can-end grasping carrier mounted on the conveyor is provided for retaining the can end blanks during the forming operations.

The press assembly in accordance with a preferred embodiment of the present invention comprises separate crankshafts for the tab press and main can end press, respectively, wherein the crankshafts are driven by a single drive system, preferably mounted to the crown of the main press. This permits the tab press crankshaft and slide to be of smaller size and weight, due to the lower forces required for tab forming, thereby resulting in lower inertias and smaller power requirements.

A further advantage according to the present invention is that different stroke lengths can be established for the tab tooling and can end tooling and the shutheights for the respective presses can be adjusted independently without the necessity for shimming, which was often the case in prior art conversion presses wherein the tab tooling and can end tooling were carried by the same slide. Because the tab and can end slides are driven by separate crankshafts, individual phase adjustment of the slides can be accomplished. Furthermore, by locating the tab tooling outside the working zone of the main press, better access can be had to both the tab tooing and can end tooling.

The present application also relates to a transfer mechanism for moving the can ends into the press and through the various tooling stations. The can ends are resiliently grasped by a plurality of carriers which are secured to a flexible belt. Thus, the mechanism for grasping and retaining the can ends is separate from the belt itself. Furthermore, the carriers are permitted to self-adjust in relationship to the apertures within the belt so that any misalignment between the carriers and downstacker or tooling, for example, can be automatically corrected.

BRIEF DESCRIPTION OF THE DRAWINGS

In the several figures of the drawings, like reference numerals identify like components, and in the drawings.

DETAILED DESCRIPTION OF THE INVENTION

Figure 1:
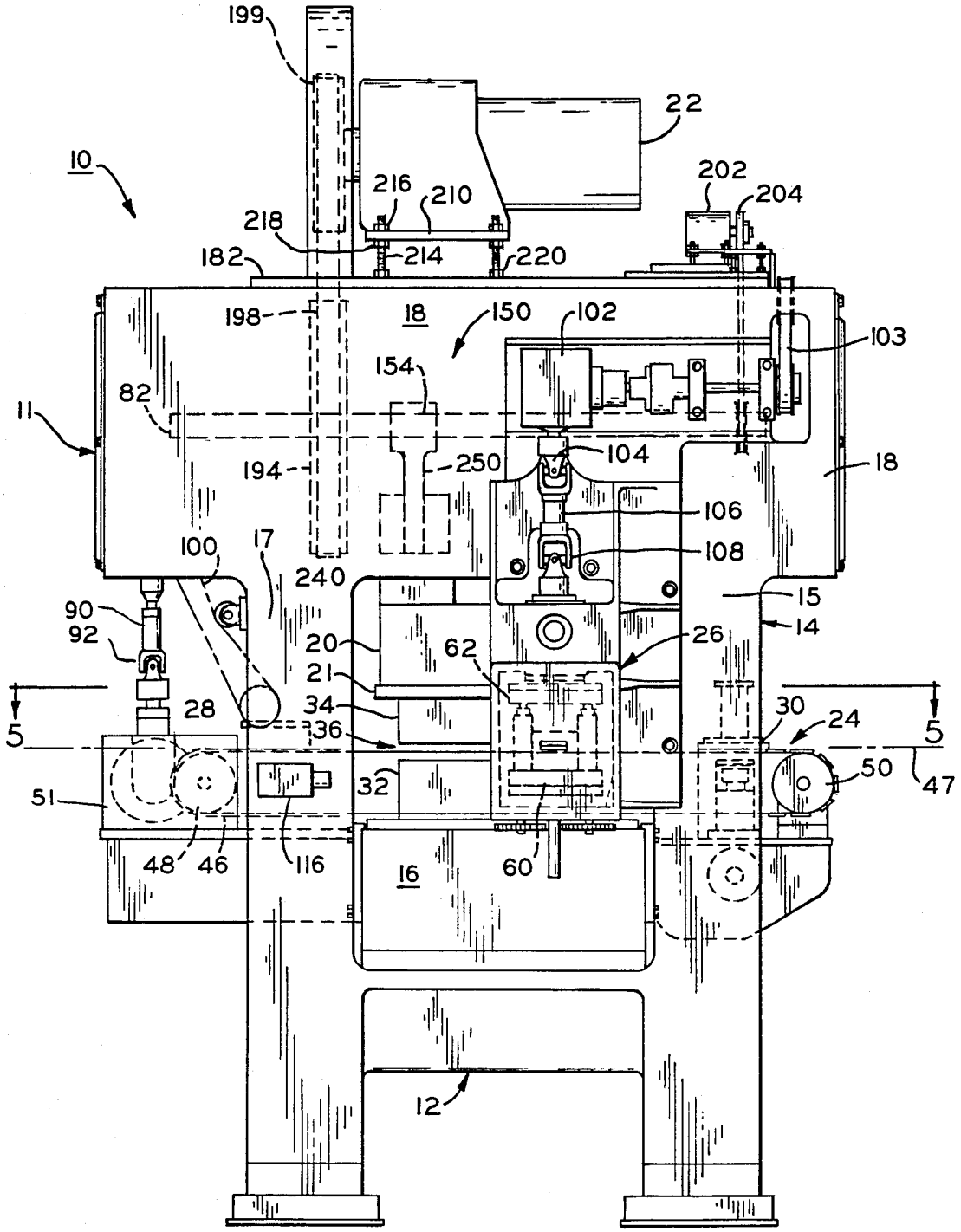
FIG. 1 is a front elevational view of the press assembly.

Press assembly 10 comprises a main press 11 including a bed 12, a frame 14, a bolster 16 mounted on bed 12, and a crown 18 vertically poitioned above bed 12 and bolster 16. Slide 20 and slide plate 21 are coupled to and operable by drive assembly 150 (FIG. 10) mounted in crown 18. Press assembly 10 includes a belt transfer conveyor 24 for the transfer of can end workpieces 135 (FIGS. 8 and 9) and a tab press 26 illustrated in FIG. 4 as being mounted on frame 14 and laterally displaced from transfer conveyor 4. Can end blanks are provided through a supply apparatus comprising a conventional downstacker 28. An upstacker 30 is mounted on press 11 for ejection from belt 24 and restacking of completed, fully formed easy-open can ends. Downstacker 28 and upstacker 30 are lcoated at opposite ends of transfer belt 24 outside the working zone 36 defined between slide 20 and bolster 16.

Main press 11 has lower can end tooling 32 mounted on bolster 16 within frame 14 and upper can end tooling 34 mounted on slide 20 in vertical alignment as shown in FIGS. 1-4 and defining therebetween working zone 36. Upper and lower can end tooling 32 and 34 can be conventional in nature and constitutes a progressive die which deforms, scores and stakes tabs on the can ends 135 in a series of operations.

Figure 5:
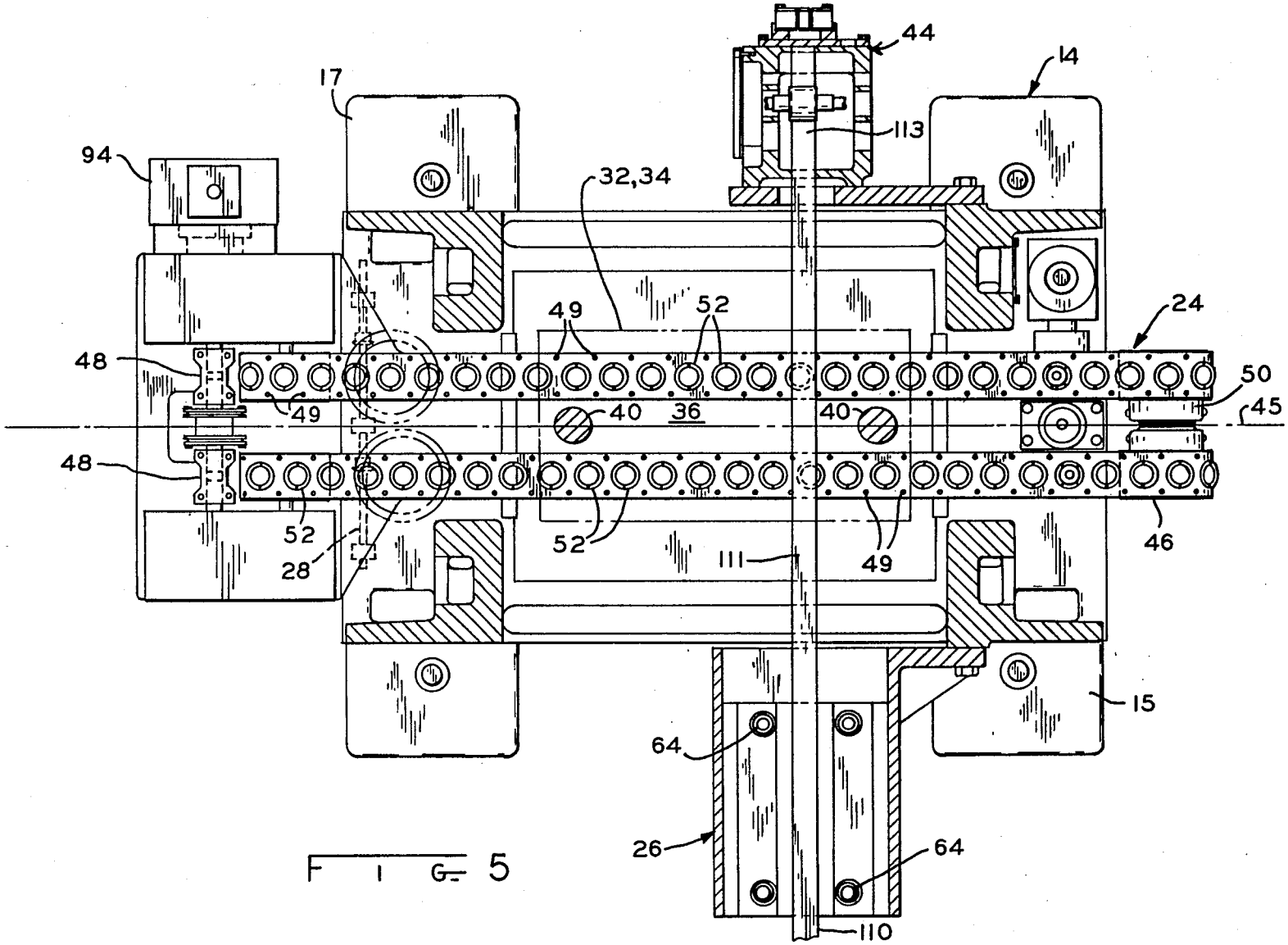
FIG. 5 is a sectional top view of the press assembly taken along line 5—5 of FIG. 1 with portions removed for clarity.

FIG. 5 illustrates transfer belt 24 extending through main press 11 and shows the location of die sets 32 and 34. In FIG. 5, the relationship of downstacker 28 and upstacker 30 are shown to be external of working zone 36 defined between upper and lower can end tooling 32, 34. Die guides 40 serve to accurately guide upper tooling 34 with respect to lower tooling 32.

Figure 10:
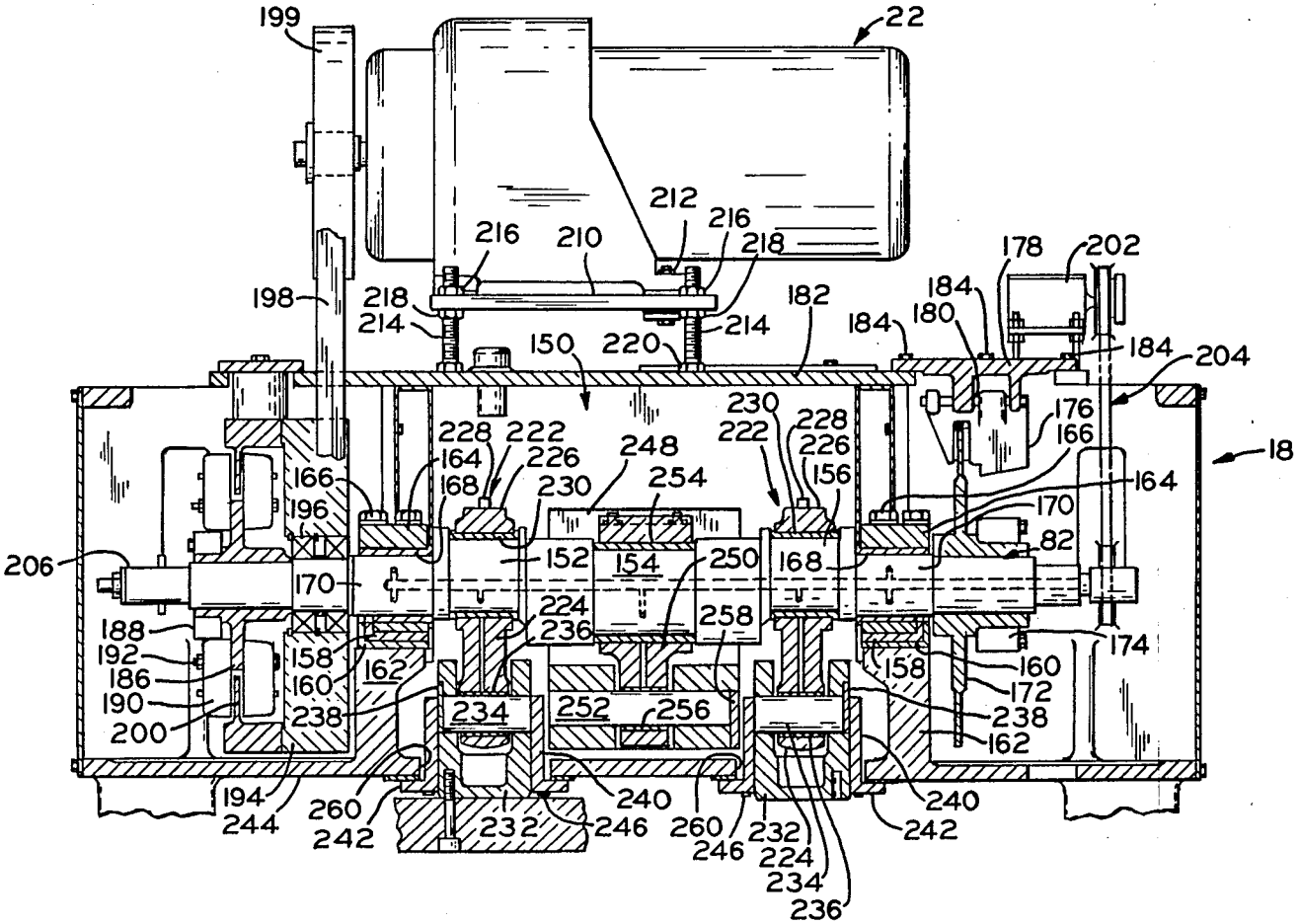
FIG. 10 is a sectional view of the crown and drive assembly of the main press taken along line 10—10 of FIG. 3.

Although a particular type of press and drive is detailed in FIG. 10, which drive is that disclosed in Shockman et al U.S. Pat. No. 4,475,278, the present invention is not limited to this particular type of press. Accordingly, this press is merely an example of one which may be used in a particular embodiment of the present invention.

As shown in the Schockman et al U.S. Pat. No. 4,475,278, slide 20 may be mounted on guideposts that are rigidly connected to and depend downwardly from crown 18 and is adapted to slide on the guideposts in a rectilinear manner within the opening 36 between crown 18 and bolster 16 and between left and right pairs of uprights 15 and 17. Alternatively, slide 20 could be guided on two guide pistons without the necessity for separate guide posts.

Referring now to FIGS. 1 and 10, drive assembly 150 will be described in greater detail. Drive assembly 150 comprises crankshaft 82 having three eccentrics 152, 154 and 156 thereon, crankshaft 82 being rotatably supported within main bearing blocks 158, which are supported on the upper support surfaces 160 of pads 162. Bearing blocks 158 are of the split type and each comprise a cap 164 connected to the lower portion thereof and to pads 162 by bolts 166. Main bearings 168 are mounted within bearing blocks 158 and the portions 170 of crankshaft 82 are journalled therein.

A brake disk 172 is mounted to the right most end of crankshaft 82 as viewed in FIG. 10 by means of ringfeder 174, and a brake caliper 176 is mounted to bracket 178 by stud and nut assembly 180 such that it engages brake disk 172 when energized. Bracket 178 is connected to cover plate 182 by screws 184.

In FIG. 10, a clutch hub 186 is frictionally clamped to crankshaft 82 by ringfeder 188, and has a plurality of calipers 190 rigidly connected thereto by bolts 192. Alternatively, a single disc clutch (not shown) could be employed. A flywheel 194 is rotatably supported on crankshaft 82 by bearings 196 and is driven by flat belt 198. Belt 198 is disposed around motor pulley 199, which is driven by motor 22. When motor 22 is energized, flywheel 194 constantly rotates but does not drive crankshaft 82 until the clutch device 190 is energized. At that time, the friction disk 200 of flywheel 194 is gripped and the rotating motion of flywheel 194 is transmitted to crankshaft 82 to calipers 190 and hub 186. Solid-state limit switch 202 is driven by a pulley and belt arrangement 204 from the end of crankshaft 82 and controls various press functions in a manner well known in the art. Rotary oil distributor 206 supplies oil to clutch 190.

Motor 22 is connected to cover plate 182 by means of mounting plate 210 and bolts 212, plate 210 being connected to cover plate 182 by studs 214 and locknuts 216, 218, and 220. The tension on belt 198 can be adjusted by repositioning plate 210 on studs 214 by readjusting the positions of lock nuts 216 and 218 along studs 214.

In the preferred embodiment, the drive assembly 150 comprises two connection assemblies 222 each comprising a connection arm 224 having a connection cap 226 connected thereto by stud and nut assembly 228. Bearings 230 are disposed between the respective connection arms 224 and the eccentrics 152 and 156 of crankshaft 82. Connection assemblies 222 are similar to those disclosed in U.S. Pat. No. 3,858,432, and comprise pistons 232 pivotably connected to connection arms 224 by wrist pins 234 and bearings 236. Keys 238 lock wrist pins 234 to pistons 232.

Pistons 232 are slideably received within cylinders 240, the later including flanges 242 connected to the lower surface 244 of crown 18 by screws 246 and sealed thereagainst by O-rings. Seals provide a sliding seal between pistons 232 and their respective cylinders 240 and are held in place by seal retainers and screws.

Press 11 is dynamically balanced to counteract the movement of connection assemblies 222 and slide 20 by means of a balancer weight 248 connected to the eccentric 154 of crankshaft 82 by counterbalance connection arm 250 and wrist pin 252. Bearings 254 and 256 have eccentric 154 and wrist pin 252, respectively, journalled therein, and key 258 locks wrist pin 252 to weight 248. Weight 248 is guided by means of a pair of guide pins connected to the lower surface 244 of the crown by screws.

Slide 20 center portion is connected to the protruding ends of pistons 232 by screws extending through the central portion of slide 20 and slide plate 21 is connected to the slide center portion by screws. As shown in FIG. 10, pistons 232 extend through openings 260 in the bottom of crown 18.

Figure 2:
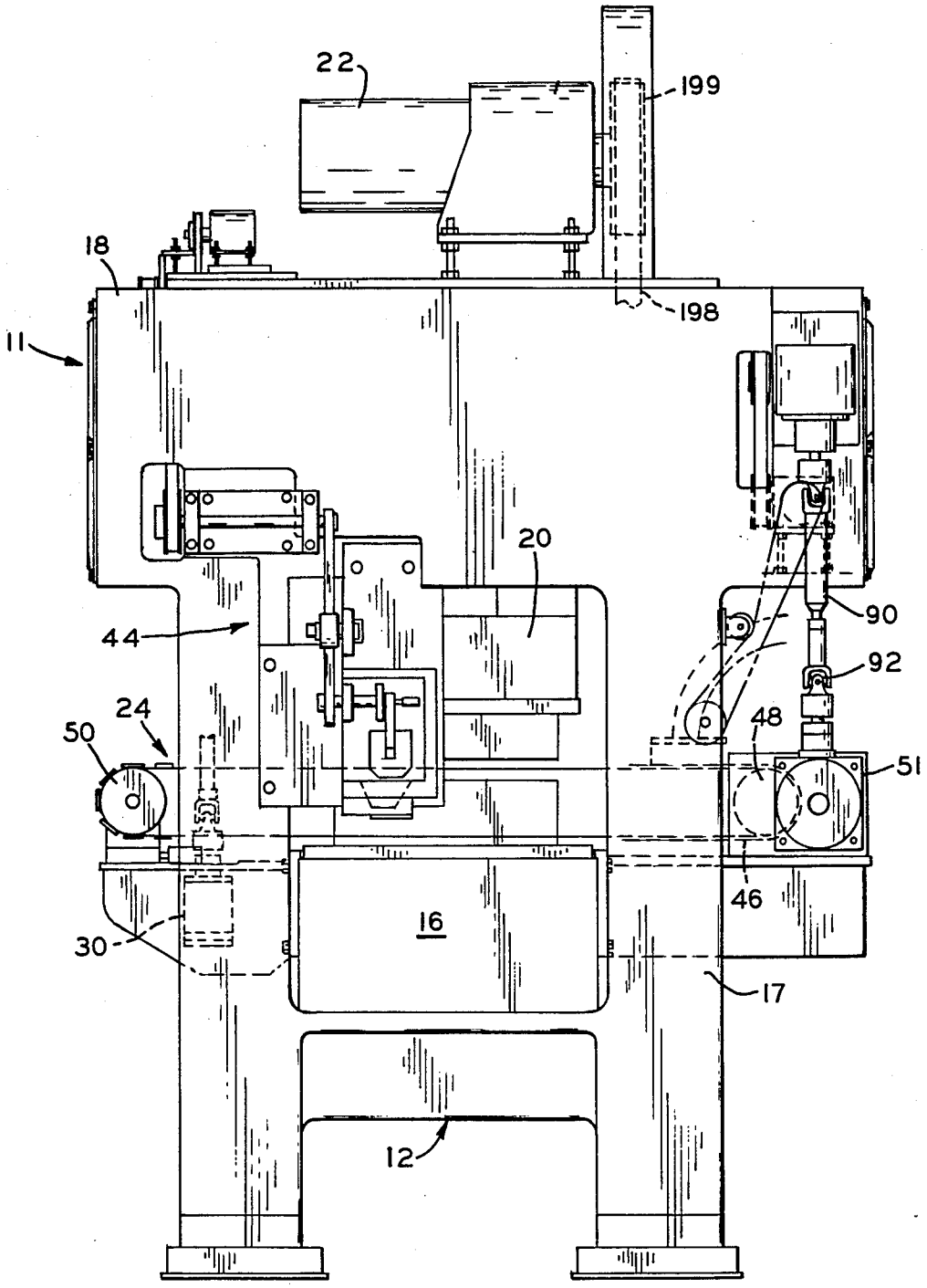
FIG. 2 is a rear elevational view of the press assembly.
Figure 3:
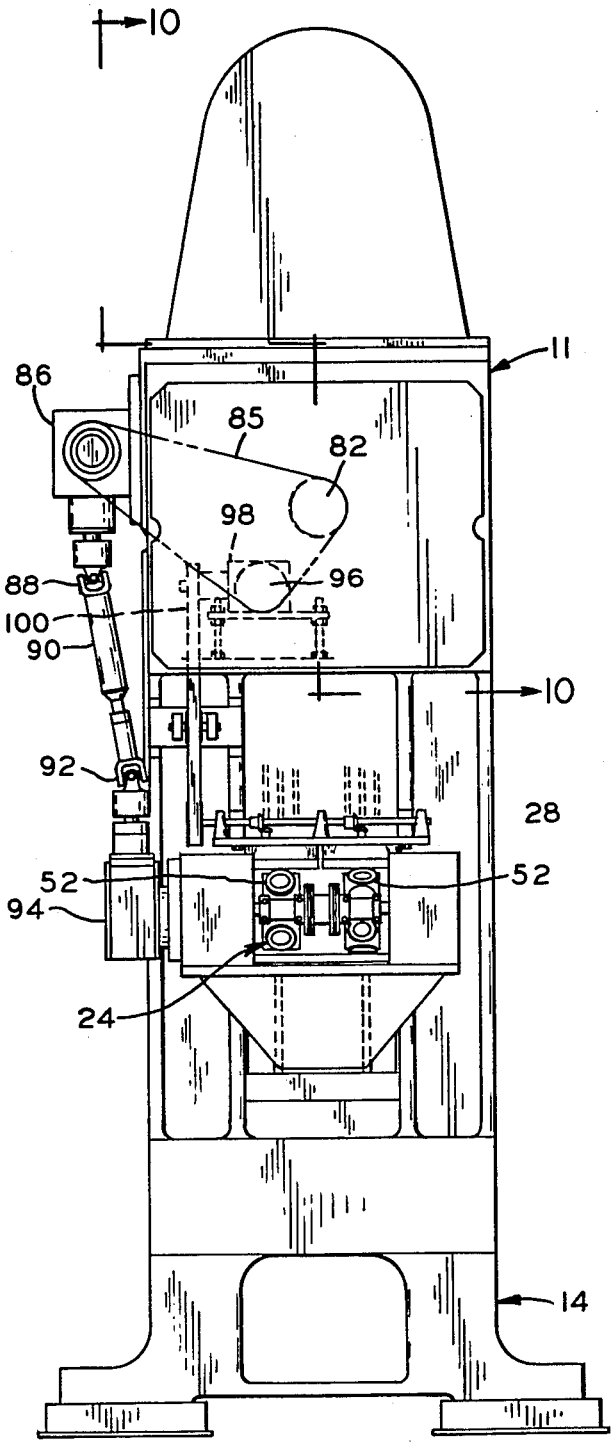
FIG. 3 is a lefthand elevational side view of the press assembly.
Figure 8:
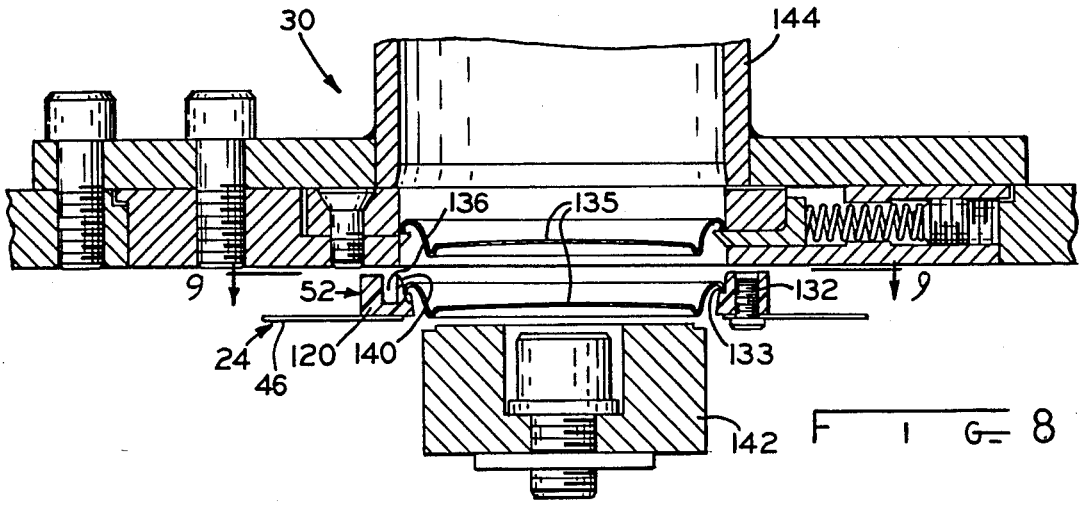
FIG. 8 illustrates in cross section the transfer belt and upstacker.
Figure 9:
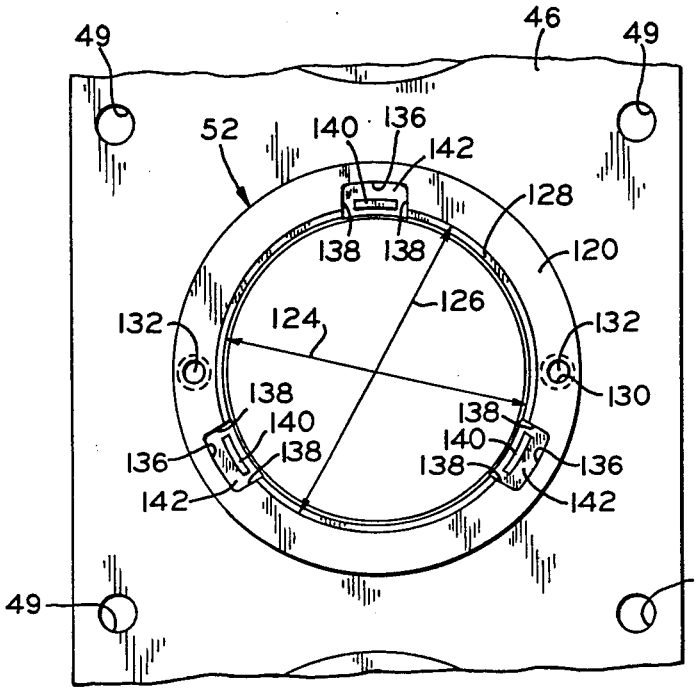
FIG. 9 is a top plan view of the belt of FIG. 8 viewed along line 9—9.

As illustrated in FIGS. 1, 2 and 5, transfer conveyor 24 is a multiple-lane, continuous belt 46 operable between drive pulley 48 and idler pulley 50, the former being driven by gear box 94. Belt 46, as shown in FIGS. 5, 8 and 9, comprises multiple can-end receiving carriers 52 which index through workstations in working zone 36 between can end tooling 34, 32. Belt 46 may include a series of holes 49 engageable with teeth (not shown) on pulleys 46 and 48 to index belt 46. Belt 46 defines a horizontal plane 47 (FIG. 1) generally parallel to bed 12 and bolster 16.

Figure 6:
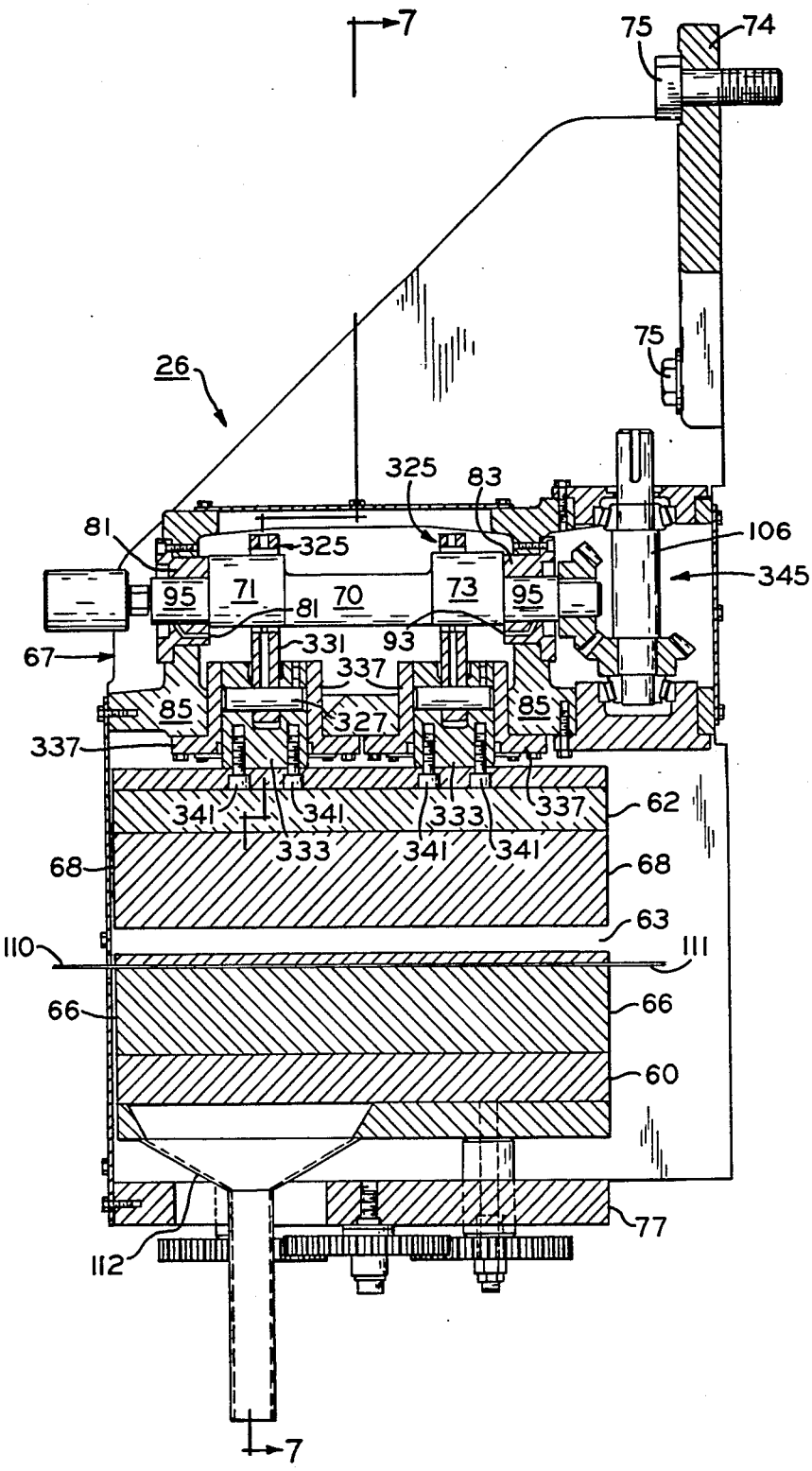
FIG. 6 is a sectional view taken along line 6—6 of FIG. 4 showing the tab press.
Figure 7:
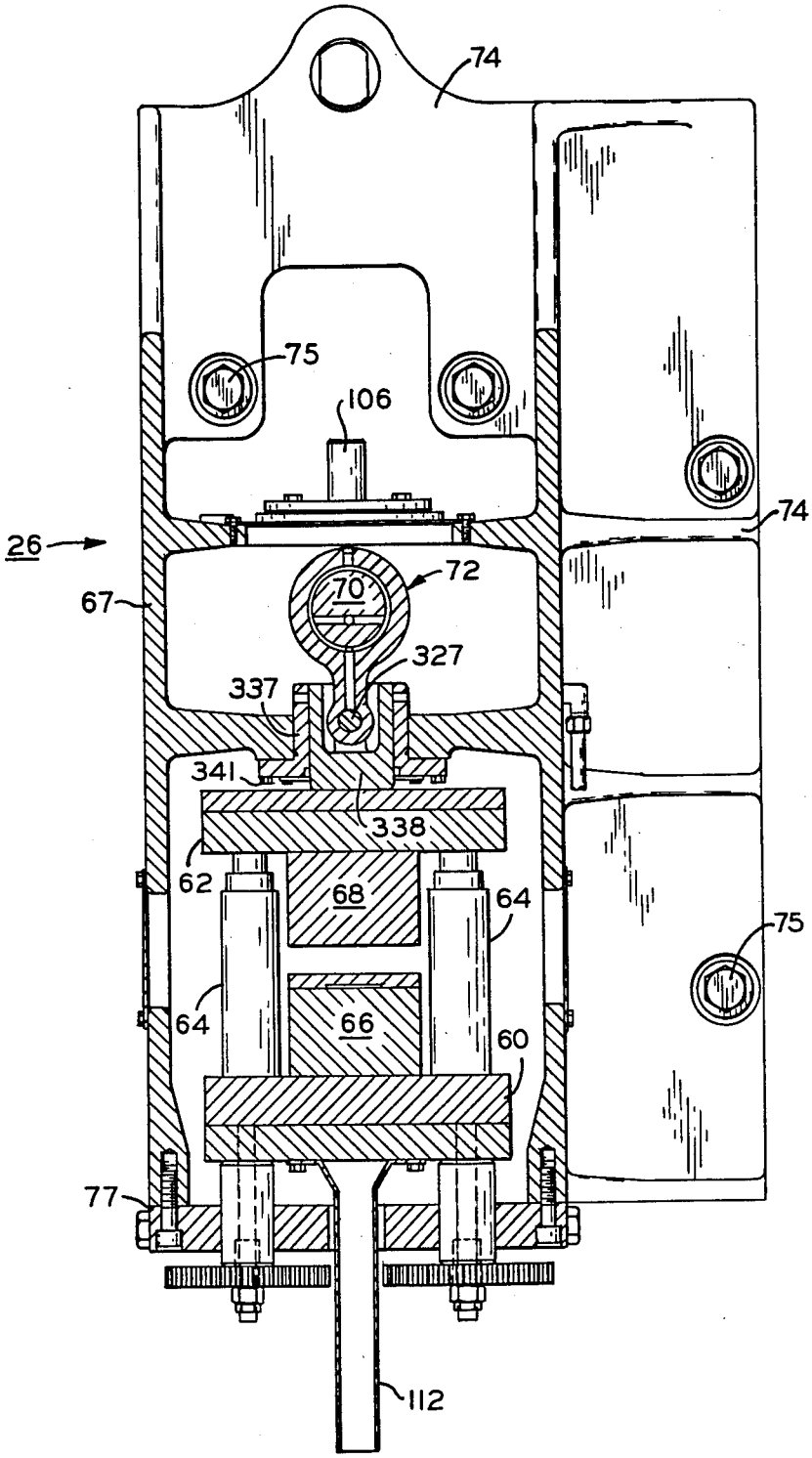
FIG. 7 is a sectional view of the tab press taken along line 7—7 of FIG. 6.

Tab press 26, which is illustrated in detail in FIGS. 6 and 7, is mounted on frame 14 and laterally displaced from working zone 36 of first press 11. In other words, tab press 26 is displaced laterally from a vertical plane which coincides with the axis 45 of transfer conveyor 24 and out of working zone 36 and is located in such a manner that tabs are fed transversely into main press 11 relative to the axis 45 of movement of can end workpieces 135. Preferably, the tabs move in a direction perpendicular to axis 45. Tab press 26 includes a bolster 60, slide 62, guides 64, lower tab tooling 66 mounted on bolster 60 and upper tab tooling 68 mounted on slide 62. Tab press working zone 63 is defined between upper and lower tab tooling 66 and 68. Tab press bolster 60 is generally parallel to plane 47 of conveyor 24. Slide 62 is operably connected to second press crankshaft 70 and drive connection assembly 72 disposed within crown 67. Tab die press 26 is not provided with a stand-alone frame, but is mounted on frame 14 by first plate 74 and bolts 75. Bolted to plate 74 is lower plate 77.

Crankshaft 70 of tab press 26, as shown in FIGS. 6 and 7, comprises first eccentric 71 and second eccentric 73. Crankshaft 70 is rotatably supported within bearing blocks 81 and 83, which are supported on pads 85 in crown 67. Connection assembly 72 comprises two connection arm assemblies 325 each comprising a wrist pin 327 and a connecting arm 331. Connecting arms 331 are connected to crankshaft eccentrics 71 and 73. Each connection arm assembly 325 further includes pistons 333 connected to connection arms 331 by wrist pins 327. Pistons 333 are slidably received in cylinders 335, the latter including flanges 337 and 339 connected to the lower surface of crown 67. Slide 62 is connected to pistons 333 by bolts 341.

Figure 4:
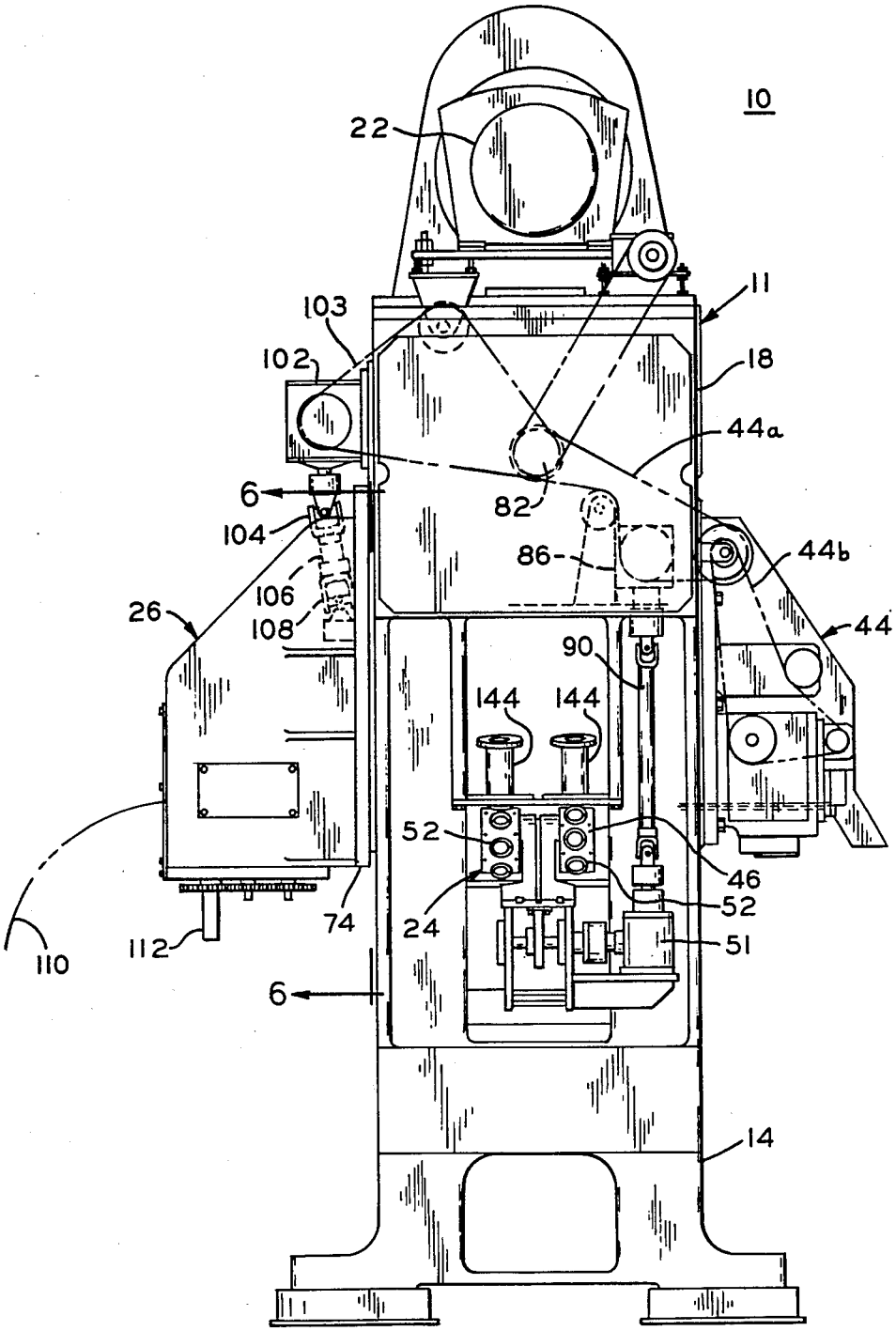
FIG. 4 is a righthand elevational side view of the press assembly.

Crankshaft 70 is shown in FIGS. 6 and 7 as being coupled to gearing 345, which is connected as shown in FIG. 1 through a universal joint 108, driveshaft 106, universal joint 104 and a change direction gearbox 102, which is connected to crankshaft 80 by belt 103 (FIG. 4). Scrap cutter 44 is similarly coupled to crankshaft 82 by a series of belts 44*a* and 44*b* as shown in FIG. 4.

Main press 11, tab press 26, belt drive 24, scrap cutter 44, downstacker 28 and upstacker 30 are all coupled to motor 22 and crankshaft 82 to be driven thereby. As shown in FIGS. 2 and 10, motor 22 is connected to pulley 199, which is coupled to crankshaft 82 by flywheel 194 and belt 198. Crankshaft 82 is coupled to gearbox 86 by belt 85 and to drive pulley 48 of transfer belt 46 through universal joint 88, drive shaft 90, universal joint 92 and change direction gearbox 94. Power from crankshaft 82 is further transmitted through gearbox 98 to drive belt 100, which drives downstacker 28.

As shown in FIG. 4, strip stock 110 is provided to tab die press 26 from a coil (not shown) and is led between tab tooling 66 and 68 for formation of the tabs. Thereafter, the strip carried tabs continue feeding between can end tooling 32 and 34 of main press 11 for staking the formed tabs 111 to formed can ends at a staking station within press 11 working zone 36. The skeleton 113 is pulled through press 11 by feed 44. A scrap cutter at the output of pull-through feed 44 shreds the skeleton 113. As shown in FIG. 6, scrap chute 112 is provided for discharging scrap from the tab forming operation of the tab press 26.

Main press 11, tab press 26, transfer conveyor 24, downstacker 28 and upstacker 30 and the feed 44 are all synchronously operable by crankshaft 82. Transfer belt 46 receives blank can ends from downstacker 28, such as by vacuum transfer, for example. Transfer conveyor 24 is synchronously operable in plane 47 with the reciprocation of slide 20 to index between the stations of tooling 32 and 34 within working zone 36.

The tabs are formed in tab press 26 by tooling 66 and 68, which constitutes a progressive die assembly. The formed tabs 111 in the strip skeleton are continuously transferred from tab press 26 in synchronized motion with the vertical operation of slide 20 for staking to formed can ends on conveyor 24 at a final staking or mounting stage within working zone 36 (FIG. 5). Thereafter, the strip is continuously fed to scrap cutter 44 and transfer conveyor 24 provides finished can ends to upstacker 30 for ejection therefrom.

Figure 8A:
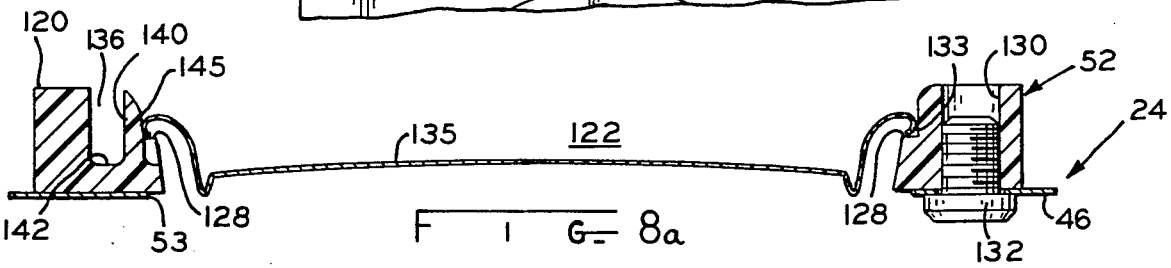
FIG. 8*a* is an enlarged sectional view of the transfer belt and carrier assembly.
Figure 8B:
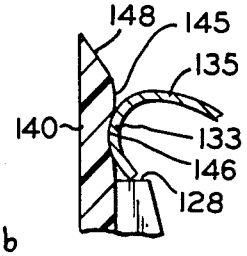
FIG. 8*b* is a further enlarged view of a portion of the carrier.
Figure 8C:
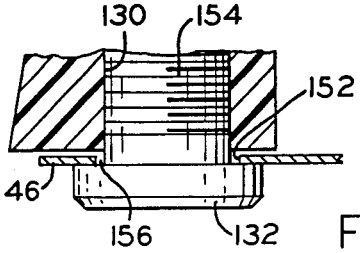
FIG. 8*c* is an enlarged sectional view of the attachment between the carrier and belt.

Referring now to FIGS. 8, 8*a* and 9, a preferred embodiment of the transfer belt is shown. Carriers 52 within apertures 53 of a flexible metal or fabric belt 46 comprise an annular body or collar 120, a bore 122, a first inner diameter 124 (FIG. 9), a second inner diameter 126 larger than the first diameter 124, and a shoulder 128 defined between the first and second diameters 124 and 126, respectively. The outer peripheral edge 133 of can end 135 is supported on shoulder 128. Carrier 52 may be made of a resilient plastic material, such as nylon, Delron or the like. Collar 120 and shoulder 128 are interrupted at three equidistantly spaced locations by recesses formed by circumferential slots 136 and pairs of radial slots 138, the latter extending from the smaller inner diameter 126 to intersect circumferential slots 136. This defines three upstanding resilient fingers 140 which extend upwardly from the lower surfaces 142 of the recesses formed by slots 136 and 138. It will be noted that the bottom surfaces 142 of these recesses are lower than the upper surface of generally annular shoulder 128, which permits fingers 140 to flex outwardly in a plane defined by the upper surface of shoulder 128.

The radially inner surfaces 145 of fingers 140 are positioned just slightly inside the circumference defined by the outer peripheral surface of can end 135 so that fingers 140 will be deflected outwardly by the presence of can end 135 in carrier 52. Each finger 140 also includes an inwardly facing recess or detent 146 adapted to resiliently capture the outer peripheral surface 133 of can end 135. It will also be noted that the upper inner surface 148 of finger 140 is angled relative to the direction of movement of can end 135 when loaded therein so as to provide a camming action causing finger 140 to deflect outwardly. Thus, fingers 140 flex outwardly when can ends 135 are inserted into carrier 52 in a downward direction and resiliently and frictionally hold can end 135 in place as the can end 135 is indexed through the various stations within main press 11. The combination of shoulder 128 and the resilient gripping of fingers 140 serve to accurately retain can ends 135 in place yet permit then to be inserted and ejected with low force. At the upstacker 30, formed can ends 135 are ejected from carriers 52 by means of ram 142 and thus loads the can ends 135 into magazine 144 (FIG. 8).

Collar 120 is connected to belt 46 by means of a threaded screw 132 received within a threaded bore 130 of collar 120. Screw 132 extends through an opening 152 in belt 46, and the opening 152 is larger in diameter than the outer diameter of the shank portion 154 of screw 152 in the area of the belt so that there is clearance 156 therebetween. This permits a certain amount of omnidirectional movement of collar 120 in the plane of belt 46 so that it can self-align with the downstacker 28 and can end tooling during loading and forming of the can ends.

Although the preferred embodiment of carrier 52 comprises three fingers 140, it is also possible to employ only two arcuate, equidistantly spaced fingers, or more than three fingers may be utilized if desired.

As discussed earlier, main press 11 and auxiliary tab press 26, since they each comprise their own crankshaft, can be adjusted independently of each other. For example, the shutheight of each press 11 and 26 can be independently adjusted by utilizing standard shutheight adjustment mechanisms. Furthermore, the stroke lengths of the presses can be independently selected because the tab tooling and can end tooling is carried by separate slides and is driven by separate crankshafts. By way of example only, the stroke length for main press 11 can be selected at $1\frac{3}{4}$ inches whereas the stroke for tab press 26 can be selected as $\frac{3}{4}$ inch. The phase relationship between the presses 11 and 26 can be adjusted by any appropriate known method. For example, timing belt 103 can be disengaged from the drive for either or both of crankshafts 82 and 70, the crankshafts then rotated to their appropriate phase relationship, and timing belt 103 again attached. Other phase adjustment mechanisms, such as adjustable clutches, adjustable cogs and collars, and the like can also be employed.

While this invention has been described as having a preferred design, it will be understood that it is capable of further modifications. This application is, therefore, intended to cover any variations, uses, or adaptations of the invention following the general principles thereof and including such departures from the present disclosure as come within known or customary practice in the art to which this invention pertains and falls within the limits of the appended claims.

What is claimed is:

1. A press assembly for producing easy-open can ends having a plurality of can end tooling stations and a plurality of tab tooling stations, said press assembly comprising:

a first press means for forming easy-open can end workpieces, said first press means including a frame, a bed with mutli-station first can end tooling means for forming said can end workpieces mounted thereon, a first slide with multi-station second can end tooling means mounted thereon for cooperating with said first tooling means, all of said can end tooling stations being located on said first press means, first press vertical guide means for guiding said slide during reciprocal motion with said bed, said bed and said slide defining a first working zone therebetween, and first crankshaft means connected to said slide for reciprocating said slide with respect to said bed;

conveyor means extending through said working zone for carrying can end workpieces between said can end tooling means;

a second press means for forming tabs, said second press means being mounted on said frame and laterally displaced from said working zone, said second press means comprising a second press bed with first multi-station tab tooling means mounted thereon, a second press slide with second multi-station tab tooling means mounted thereon, said second press first and second tab tooling means defining a second press working zone therebetween, a second crankshaft means separate from said first crankshaft means for reciprocating said second slide relative to said second bed, and second guide means for guiding said second press slide for reciprocal movement relative to said bed;

a single drive means supported on said frame and drivingly connected to both said first crankshaft means and said second crankshaft means for rotating said crankshaft means in synchronism with each other; and means for feeding tabs formed in said second press into said first press for attachment to can end workpieces;

whereby locating the tab tooling means and the can end tooling means on separate presses driven by separate crankshafts enables independent timing and independent press tonnage selection for the tab and can end operations.

2. The press assembly of claim 1 wherein said conveyor means extends through said first working zone along a first axis, said second press working zone is laterally displaced from a vertical plane coextensive with said first axis, and said means for feeding feeds said tabs into said first press working zone in a direction transverse to said axis.

3. The press assembly of claim 1 wherein said second press means includes a frame connected to said main frame, and said second press frame includes a crown portion in which said second press crankshaft means is mounted.

4. The press assembly of claim 1 wherein said drive means comprises a motor and rotary motion transmitting means connected between said motor and said first and second crankshaft means.

5. The press assembly of claim 4 wherein said motor is mounted on said first press means and said motion transmitting means comprises a belt and pulley assembly.

6. The press assembly of claim 1 wherein said conveyor means is a multiple lane conveyor belt.

7. The press assembly of claim 6 wherein said belt includes a plurality of apertures, each of said apertures having grasping means therein for securely holding can end workpieces during can end forming.

8. The press assembly of claim 1 further comprising feed means for providing can end blanks to said conveyor means.

9. The press assembly of claim 1 comprising discharge means for ejecting can end and tab assemblies from said conveyor means.

10. A press assembly for producing easy-open can ends comprising:

a first press means for forming easy-open can end workpieces and attaching tabs thereto comprising a frame, a bed with multi-station first tooling means for forming can ends mounted thereon, a slide with second multi-station tooling means for forming can ends mounted thereon, a first press vertical guide means for guiding said slide during reciprocal motion with said bed, said slide and bed being generally parallel to each other and defining a working zone therebetween, and drive means comprising a first crankshaft connected to said slide to reciprocally move said slide with respect to said bed;

conveyor means extending through said working zone along an axis for carrying can end workpieces, said conveyor means being driven by a pulley assembly;

second press means for forming tabs, said second press being mounted on said frame and laterally spaced from said working zone in a direction laterally spaced from a vertical plane coextensive with the conveyor axis, said second press means having a bed with multi-station tab first tooling mounted thereon, a press slide with multi-station tab second tooling mounted thereon, a second crankshaft connected to said second slide, said second crankshaft being separate from said first crankshaft, and vertical guide means for guiding said second press slide for reciprocal motion with said second press bed;

means for feeding strip stock to said second press first and second tooling means for feeding tabs from said second press to said first working zone wherein tabs are fastened to the can end workpieces by the first press tooling;

said pulley assembly and said second press slide crankshaft being operably connected to said drive means whereby said first and second presses and said conveyor means are moved in synchronism, whereby locating the tab tooling means and all the can end tooling means on separate presses driven by separate crankshafts enables independent timing and independent press tonnage selection for the tab and can end operations.

11. The press assembly of claim 10 further comprising a scrap cutter mounted on said frame to receive and cut up tab strip stock.

12. The press assembly of claim 10 wherein said conveyor is a multiple lane conveyor belt.

13. The press assembly of claim 10 wherein said belt defines at least one aperture, each of said apertures having a disk grasping means therein for resiliently holding can end workpieces during said can end forming.

14. The press assembly of claim 13 wherein said disk grasping means includes a collar with a generally annular shape and a central opening, said collar having a wall with an outer diameter, a first inner diameter, a second inner diameter and a shoulder at the junction of said first and second inner diameter, and a plurality of resilient finger means extending from said collar for resiliently grasping a can end workpiece.

15. The press assembly of claim 10 further comprising downstacker feed means for providing can end blanks to said conveyor means, and discharge and stacking means for ejecting formed can ends from said conveyor means.

16. The press assembly of claim 15 wherein said discharge and stacking means includes a ram operable to contact and move finished can ends to a magazine for holding the finished can ends in stacked relationship.

* * * * *